US005488943A

United States Patent [19]

Whitfield et al.

[11] Patent Number: 5,488,943

[45] **Date of Patent: *Feb. 6, 1996**

[54] SELF-DISTRIBUTING COMBUSTION GRATE FOR PELLET FUELED STOVES

[75] Inventors: Oliver J. Whitfield, Bow; John B. Tacke, Jr., Burlington, both of Wash.

[73] Assignee: Pyro Industries, Inc., Burlington, Wash.

[ * ] Notice: The term of this patent shall not extend beyond the expiration date of Pat. No. 5,295,474.

[21] Appl. No.: 330,781

[22] Filed: Oct. 28, 1994

Related U.S. Application Data

[63] Continuation-in-part of Ser. No. 104,218, Aug. 9, 1993, Pat. No. 5,383,446, which is a continuation-in-part of Ser. No. 805,495, Dec. 11, 1991, Pat. No. 5,295,474, which is a continuation-in-part of Ser. No. 745,204, Aug. 14, 1991, Pat. No. 5,137,010.

[51] Int. Cl.[6] ..... F23H 13/00

[52] U.S. Cl. ..... 126/152 R; 126/152 B

[58] Field of Search ..... 126/152 R, 173, 126/154, 147, 152 B; 110/110, 267, 327

[56] References Cited

U.S. PATENT DOCUMENTS

| | | | |
|---|---|---|---|
| 91,357 | 6/1869 | Mayer . | |
| 159,666 | 2/1875 | Goodfellow . | |
| 159,667 | 2/1875 | Goodfellow . | |
| 254,688 | 3/1882 | Parkison | 126/167 |
| 624,673 | 5/1899 | Ostad et al. . | |
| 790,166 | 5/1905 | Wood-Allen . | |
| 840,861 | 1/1907 | Neill . | |
| 876,670 | 1/1908 | Walker . | |
| 902,002 | 12/1908 | Rathbone . | |
| 1,008,480 | 11/1911 | Latta . | |
| 1,239,717 | 9/1917 | Pierce | 126/152 R |
| 1,585,449 | 5/1926 | Welsh . | |
| 1,648,976 | 11/1927 | Wagner . | |
| 1,860,442 | 5/1932 | Wares . | |
| 1,943,209 | 1/1934 | Davis | 126/164 |
| 1,977,176 | 10/1934 | De Reytere | 126/152 |
| 2,315,070 | 3/1943 | McNaughton | 126/99 |
| 2,367,590 | 1/1945 | Lewers et al. | 110/7 |
| 2,447,938 | 8/1948 | Garfunkle . | |
| 2,739,547 | 3/1956 | Triggs | 110/18 |
| 4,007,697 | 2/1977 | Prill | 110/45 |
| 4,185,956 | 1/1980 | Balster | 432/258 |
| 4,280,474 | 7/1981 | Ruegg, Sr. | 126/121 |
| 4,334,517 | 6/1982 | Sweitzer | 126/121 |
| 4,383,517 | 5/1983 | Gillis et al. | 126/61 |
| 4,426,937 | 1/1984 | Sietmann et al. | 110/288 |
| 4,430,948 | 2/1984 | Schafer et al. | 110/101 R |
| 4,449,462 | 5/1984 | Robb | 110/288 |
| 4,517,905 | 5/1985 | Chastain et al. | 110/346 |
| 4,548,194 | 10/1985 | Schafer et al. | 126/110 R |
| 4,565,184 | 1/1986 | Collins et al. | 126/368 |
| 4,947,769 | 8/1990 | Whitfield | 110/259 |
| 5,137,010 | 8/1992 | Whitfield et al. | 126/173 |
| 5,295,747 | 3/1994 | Whitfield et al. | 126/152 R |
| 5,383,446 | 1/1995 | Whitfield | 126/152 R |

FOREIGN PATENT DOCUMENTS

| | | | |
|---|---|---|---|
| 1076708 | 10/1954 | France . | |
| 668440 | 11/1938 | Germany | 126/173 |
| 59-157417 | 9/1984 | Japan | F23G 9/00 |
| 28336 | 10/1914 | United Kingdom . | |

OTHER PUBLICATIONS

Brochure, Pyro Industries, Inc., *From Waste to Warmth*, Copyright 1991.

*Primary Examiner*—Larry Jones
*Attorney, Agent, or Firm*—Christensen O'Connor Johnson & Kindness

[57] ABSTRACT

Stoves fueled by biomass pellets are provided with a grate assembly that supports the pellets for combustion and directs combustion gas into the fire. The grate assembly includes a passive grate of equally or unequally spaced rods. The design of the rods serves to prevent the ash and clinkers from accumulating on the grate in amounts that could reduce the flow of combustion gas into the fire. In one embodiment, the rods define a surface that serves to distribute unburned fuel pellets from a location where they are deposited from a fuel feed conduit.

12 Claims, 14 Drawing Sheets

49
241
235
237
213
209
251
201
221
223
227
215
241
251
211
207
30

SELF-DISTRIBUTING COMBUSTION GRATE FOR PELLET FUELED STOVES

This application is a continuation-in-part of U.S. patent application Ser. No. 08/104,218 filed Aug. 9, 1993 now U.S. Pat. No. 5,383,446 which in turn is a continuation-in-part of U.S. patent application Ser. No. 07/805,495 filed Dec. 11, 1991 now U.S. Pat. No. 5,295,474 which in turn is a continuation-in-part of U.S. patent application Ser. No. 07/745,204 filed Aug. 14, 1991, now U.S. Pat. No. 5,137,010.

FIELD OF THE INVENTION

The present invention relates to combustion grates for stoves that are fueled by pellets formed from biomass materials.

BACKGROUND OF THE INVENTION

Stoves for burning fuel in the form of pellets manufactured from biomass are known to provide acceptable alternative heat sources for conventional heating units such as gas, electric and oil furnaces. Such stoves generally include a sealable firebox into which is fed fuel and air or other gases to support the combustion of the fuel. Stoves for residential heating utilize either a top feed mechanism that delivers the pelletized fuel onto a grate or a bottom feed system that forces the pellets into a burn pot from below. The top feed system is generally considered to be preferable due to its simpler design. In a top feed system, in order to provide sufficient amounts of combustion gases to the fuel, the grate onto which the fuel is deposited includes a perforated plate wherein the combustion gases pass through the perforations into the burning fuel. The major drawback of the top feed system has been the inability to remove the non-combustible ash and clinkers from the grate after combustion of the pellets. The accumulation of the ash and clinkers is troublesome because it eventually blocks the flow of air through the perforations in the grate and into the fire. This results in reduced heat output and burning efficiency.

Accordingly, there is a need for an improved grate and grate assembly which provide the advantages described above with regard to perforated grates, without suffering from the drawbacks associated with the accumulation of non-combustible ash and clinkers. A suitable grate and grate assembly would allow for the effective removal of non-combustible ash and clinkers from the grate to prevent clogging of the perforations in the grate.

Another drawback of pellet-burning stoves that employ top feed systems is the difficulty in maintaining the fuel in a compact volume for efficient combustion, particularly at low feed rates. With low feed rates, there is a tendency for the fuel pellets to spread out and form a thin layer. The combustion of fuel pellets in a thin layer is generally less efficient than combustion of fuel pellets that are maintained in a compact volume.

Accordingly, there is also a need for an improved grate and grate assembly that employs a perforated grate and is designed to concentrate and maintain the fuel pellets in a compact volume so that the efficiency of combustion at low feed rates is high.

Grates and grate assemblies that concentrate and maintain fuel in a compact volume for efficient combustion at low feed rates must also be suitable for combustion at high feed rates. At high feed rates, in certain grates designed to concentrate fuel, there is a tendency for the fuel to build up to volumes and depths that hinders the ability of the grate to effectively remove ash and clinkers. For example, in top feed systems, one of the factors that contributes to the removal of ash and clinkers through the perforations of the grate is the breakup of clinkers by the force of fresh fuel pellets falling on the pile of partially or fully combusted fuel. If the grate allows the fuel pellets to build up to an excessive depth, the force of the falling fuel pellets is not transmitted to the bottom of the fuel pile where the clinkers are most prevalent.

Accordingly, there is a need for an improved grate assembly that overcomes the foregoing problem of excessive fuel buildup with the consequence of reduction of clinker breakup.

SUMMARY OF THE INVENTION

The present invention provides a grate and a grate assembly for a stove fueled by biomass pellets that overcome the problem of accumulation of ash and clinkers encountered by conventional grates, which can block perforations in the grate. By preventing the accumulation of ash and clinkers which can block perforations in the grate, the flow of combustion gas into the fire is maintained at a level which allows the stove to bum the fuel efficiently and provide an efficient heat output. In addition to providing the advantages discussed above, the grate and grate assembly allow removal of the ash and clinkers from the grate to a location where they can be readily removed from the stove.

In one aspect, a grate assembly formed in accordance with the present invention includes a planar plate that serves to support biomass pellets above an ash pan in the stove. The planar plate includes at least one elongate slot that passes through the planar plate. Extending parallel to the elongate slot over the planar plate is an elongate blade that includes a first end and a second end opposite the first end. A first skid and a second skid are attached to the elongate blade. The first skid and second skid rest on the upper surface of the planar plate to position the elongate blade in a plane spaced above the planar plate. The elongate blade is attached to an arm; movement of the arm causes the blade to move in a direction substantially transverse to the elongate slot.

In operation, the elongate blade moves back and forth across the grate in a direction substantially transverse to the elongate slot. Movement of the elongate blade pushes non-combustible ash into the slot where it drops through the planar plate and into the ash pan below. Movement of the elongate blade also helps to break up clinkers as they are forming and push them into the elongate slot. In this manner, the grate assembly formed in accordance with the present invention serves to minimize or prevent the accumulation of ash and clinkers on the upper surface of the planar plate. If not removed, the accumulated ash and clinkers can block the slot through which combustion gases normally flow to fuel the fire. A reduction of the flow of combustion gas into the fire is undesirable because it reduces the efficiency of combustion and heat output of the stove.

In another aspect, the present invention is a passive grate that includes a planar plate having at least one elongate slot that passes through the planar plate. At least one end of the elongate slot substantially abuts an end of the planar plate. The plate is used for stoves that are fueled by biomass pellets. In preferred embodiments of this aspect of the present invention, the grate includes a plurality of slots having ends that substantially abut the transverse ends of the planar plate. The slots are dimensioned to allow fuel to be supported on the plate and ash to fall through the plate, while at the same time providing a velocity of combustion air through the slots which is insufficient to result in substantial dispersion of the ash.

In another embodiment, a passive grate formed in accordance with the present invention includes a plurality of elongate rods positioned in a parallel arrangement. The elongate rods are spaced apart from each other. The plurality of rods can be divided into subsets that comprise two adjacent rods. In this embodiment, the spacing between the rods of one subset is unequal to the spacing of the rods of an adjacent subset. In a preferred embodiment, the plurality of elongate rods includes a center rod or two rods, and the distance between adjacent rods decreases as one moves farther away from the center rod or rods. The unequal spacing between the rods allows larger amounts of combustion air to be introduced through the center of the grate with less air passing through the outer portions of the grate. Additionally, the narrower spacing between the rods near the outer edges of the grate helps to maintain the smaller partially burned pellets (that tend to collect near the edges of the grate) on the grate until they can be more completely combusted.

In another aspect, the present invention is a passive grate that includes a plurality of elongate rods positioned in a parallel arrangement wherein a trough is defined by the elongate rods for concentrating the unburned biomass pellets. The elongate rods may be spaced equally or unequally from each other. In the preferred embodiment, the trough formed by the rods is positioned directly below the location where fuel is introduced onto the grate. Different embodiments of this aspect of the present invention include a trough that has a cross section transverse to the length of the rods that is V-shaped, U-shaped, or trapezoidal in shape.

In another aspect, the present invention is a passive grate that includes a plurality of elongate rods positioned in a parallel arrangement wherein an upper surface is defined by the elongate rods for distributing the unburned biomass pellets. The elongate rods may be spaced equally or unequally from each other. In this aspect of the present invention, the grate includes a left edge and an opposing right edge. An intermediate position between the left edge and the right edge is positioned directly below the location where fuel is introduced onto the grate. The rods at the left edge and the right edge are below the rods at the intermediate position. Different embodiments of this aspect of the present invention include rods in a pattern that has a cross section transverse to the length of the rods that is substantially convex, for example an inverted V-shape, an inverted U-shape, arcuate, or stepped, such as semitrapezoidal in shape.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 15 is a perspective view of a grate assembly including the selfdistributing feature of the present invention.

DETAILED DESCRIPTION OF THE PREFERRED EMBODIMENT

A grate assembly formed in accordance with the present invention is designed for use in a stove fueled by biomass pellets. Biomass pellets are typically made from materials such as wood waste, agricultural residue, paper, coal dust, garbage, and the like. These types of pellets are generally preformed in the shape of small cylinders, although other shapes of preformed fuel can be burned in accordance with the present invention. The advantages of using a grate assembly and passive grate formed in accordance with the present invention are particularly evident when used in combination with biomass pellets that contain more than about one percent ash. Combustion of pellets having an ash content greater than about one percent produces a volume of ash and clinkers that, if not removed by the grate assembly of the present invention, will eventually cause blockage of the combustion air holes in the grate.

Figure 1:
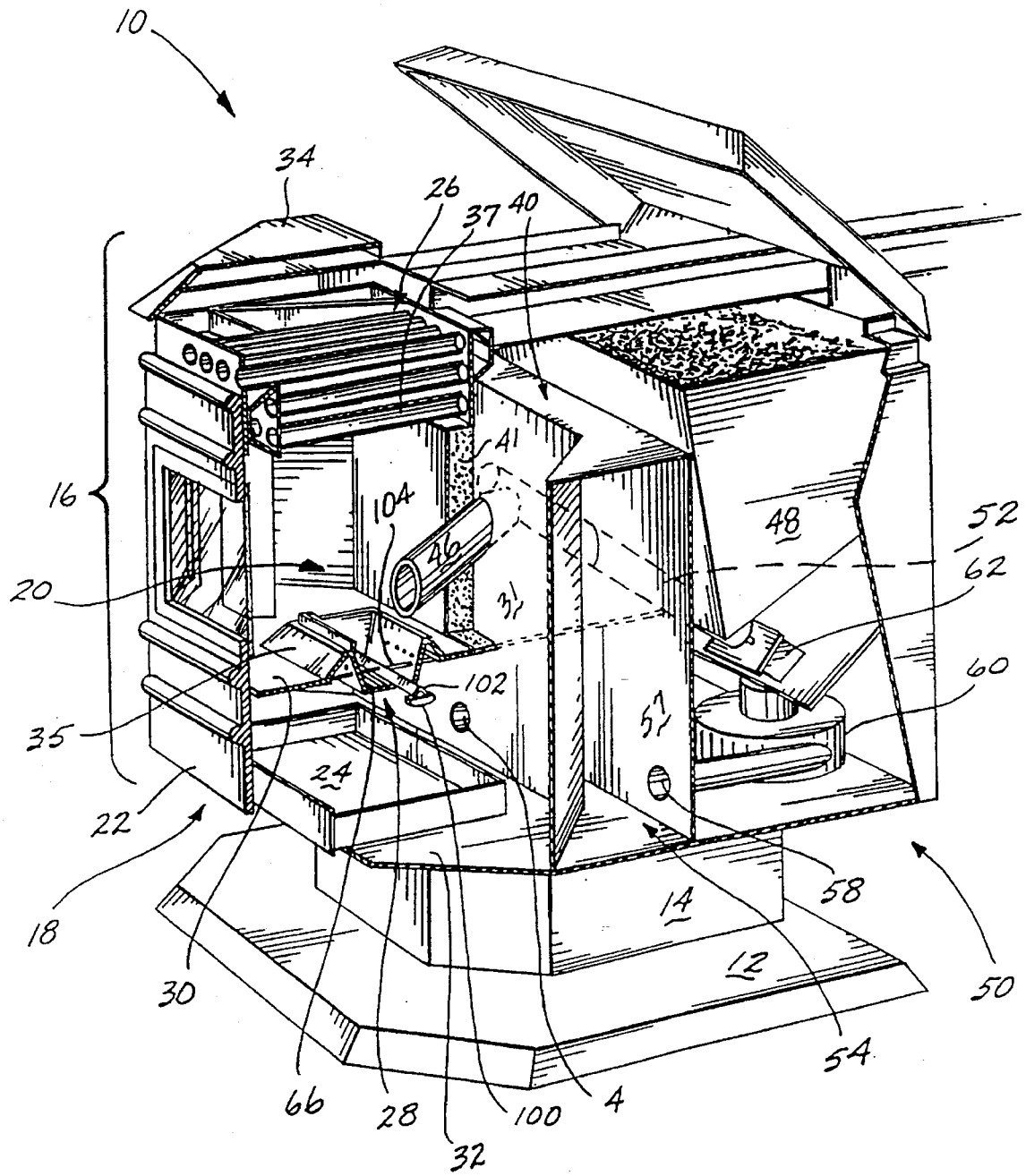
FIG. 1 is a perspective view of a stove fueled by biomass pellets with a portion cut away including a grate assembly, including a passive grate formed in accordance with the present invention.

Referring to FIG. 1, stove 10 is fueled by biomass pellets and includes a flat rectangular base 12. Centered on top of base 12 is a generally rectangular pedestal 14. Resting on top of rectangular pedestal 14 spaced above base 12 is body 16 of stove 10. Stove body 16 is generally cubical in shape and includes a front section 18 that includes firebox 20, door 22, ash pan 24, heat exchange unit 26, grate assembly 28, and platform 30.

Firebox 20 is an upright chamber having a cross section in a horizontal plane generally in the shape of a hexagon. The forward-most three sides of firebox 20 are defined by door 22 that includes three window-panels in the configuration of a bay window. The side of firebox 20 opposite door 22 is defined by fire wall 31. The left and right sides of door 22 and fire wall 31 are connected by the remaining two sides of firebox 20. Firebox 20 is closed in at its bottom by floor 32 and at its top by lid 34.

Heat exchange unit 26 is positioned at the top of front section 18 within firebox 20. Heat exchange unit 26 includes a shell and tube type of heat exchanger. The shell side of heat exchanger 26 carries hot gases from the combustion of fuel within firebox 20. The tube side of heat exchanger 26 carries air to be heated and dispensed from the stove. Spaced below heat exchange unit 26 about two-thirds of the way down firebox 20 is horizontal platform 30 that forms a false floor within firebox 20. Platform 30 is supported by fire wall 31 and the sides of firebox 20 extending between fire wall 31 and door 22. In order to allow door 22 to open, platform 30 abuts door 22 and seals against door 22 when it is in a closed position, but is not attached thereto. The center of platform 30 is cut away to provide an opening through to the bottom of firebox 20. As described below in more detail, the remaining portion of platform 30 defines a shelf that runs around the periphery of firebox 20 and is sealed against the walls of firebox 20 and serves to support bulkhead 35 which suspends grate assembly 28 above floor 32.

Ash pan 24 is located on floor 32 directly beneath the opening in platform 30. In this position, ash pan 24 collects ash and clinkers that are displaced from grate assembly 28 in accordance with the present invention. Preferably, ash pan 24 can be removed from firebox 20 so that cleaning of firebox 20 is simplified.

Firebox 20 shares fire wall 31 as a common wall with middle section 40. Fire wall 31 extends between the lower-most set of tubes 37 in heat exchange unit 26 and floor 32 and isolates elements behind it from the heat of firebox 20. A portion of fire wall 31 from a point below heat exchange unit 26 to platform 30 includes a layer 41 of heat insulating material further isolating elements behind layer 41 and fire wall 31 from the heat of firebox 20. Heat insulating layer 41 should be selected from low cost materials with good insulating properties.

Below insulating layer 41, and platform 30, a passage 42 passes through fire wall 31. Passage 42 allows primary combustion air in middle section 40 or from outside the stove to pass through fire wall 31 into front section 18 and ultimately into the grate assembly 28 as described below in more detail.

Passing at about a 45 degree angle downward through fire wall 31 and heat insulating layer 41 toward the front of stove 10 is fuel feed conduit 46. Fuel feed conduit 46 terminates above grate assembly 28 and delivers pelletized fuel to grate assembly 28 as described below.

To the rear of fire wall 31 is middle section 40. Middle section 40 is a chamber 54 extending the full width of stove body 16 and extending upward from floor 32 to above the lower-most set of tubes 37. Middle section 40 shares a common wall 57 with rear section 50 which is described below in more detail. Wall 57 is spaced rearwardly from fire wall 31. The top of wall 57 is connected to the top of fire wall 31 by a metal plate. The sides of wall 57 are connected to the sides of fire wall 31 by the sides of stove body 16. Accordingly, chamber 54 is defined between front section 18 and middle section 50. Chamber 54 acts as a plenum for air to be provided to fuel the fire and to carry heat into the surrounding room. Chamber 54 receives combustion air through opening 58 located near the bottom of wall 57. Opening 58 is connected to blower 60 that can pressurize chamber 54, causing air to flow through passage 42 into firebox 20. The volume of air in chamber 54 that does not enter firebox 20 through passage 42 moves upward and enters the lower-most set of tubes 37 and passes through heat exchange unit 26 where it is heated and eventually introduced into the surrounding room. Although the present invention is described in the context of a stove that includes a single blower for combustion and convection air, stoves having other arrangements for providing combustion air and convection air will benefit from the present invention.

Fuel feed conduit 46 also passes through middle section 40, including wall 57, where it enters into rear section 50. Rear section 50 comprises the balance of stove 10 to the rear of middle section 40. Rear section 50 is a generally upright rectangular box encasing fuel bin 48, auger 52, auger motor 62, and blower 60.

Blower 60 is located in the bottom of rearward most section 50. Spaced above blower 60 is auger 52 and auger motor 62. Positioned directly above auger motor 62 and occupying the upper half of rear section 50 is fuel bin 48. Auger motor 62 delivers pelletized fuel from the bottom of fuel bin 48 to feed conduit 46 via auger 52. Auger 52 angles upward from the bottom of fuel bin 48, toward the front of stove 10. Auger 52 and fuel feed conduit 46 meet at a point just rearward of wall 57 where fuel in auger 52 is dumped into the top of fuel feed conduit 46. As described below in more detail, auger motor 62 also energizes the grate assembly 28 formed in accordance with the present invention.

In operation, fuel pellets are delivered from fuel bin 64 through auger 52 and fuel conduit 46 onto grate assembly 28. Blower 60 pressurizes chamber 54 slightly, causing combustion air to pass through passage 42 into firebox 20. Combustion of the pelletized fuel produces heat that is transferred via heat exchange unit 26 to the air that is passing through the tube side of heat exchange unit 26. The heated air eventually passes into the open room. As the fuel is combusted, non-combustible ash and clinkers begin to form on grate assembly 28. As described below in more detail, grate assembly 28, including the passive grate formed in accordance with the present invention is designed to remove the ash and clinkers from the grate.

Figure 2:
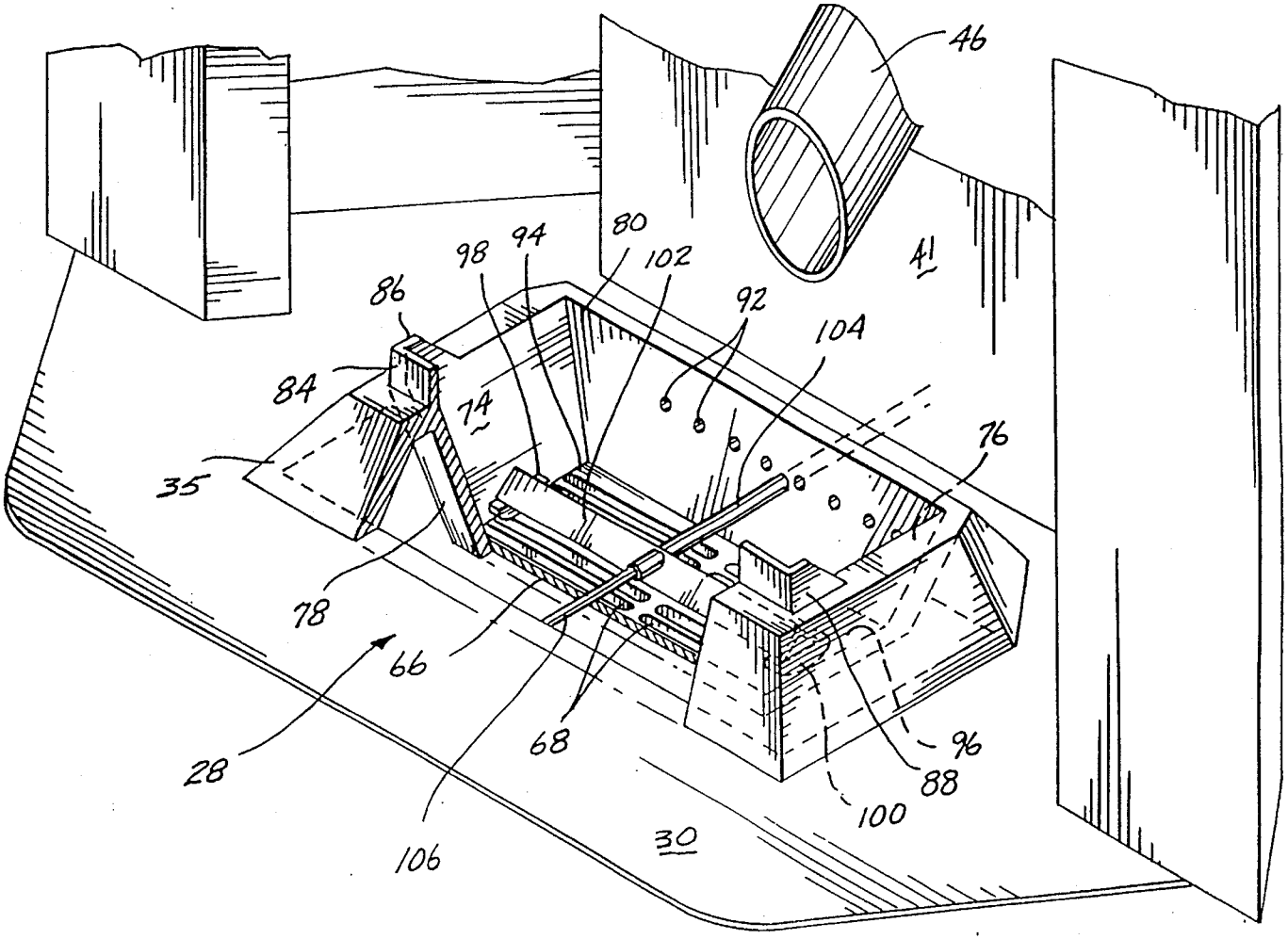
FIG. 2 is an enlarged perspective view of the grate assembly of FIG. 1 with a portion cut away.
Figure 3:
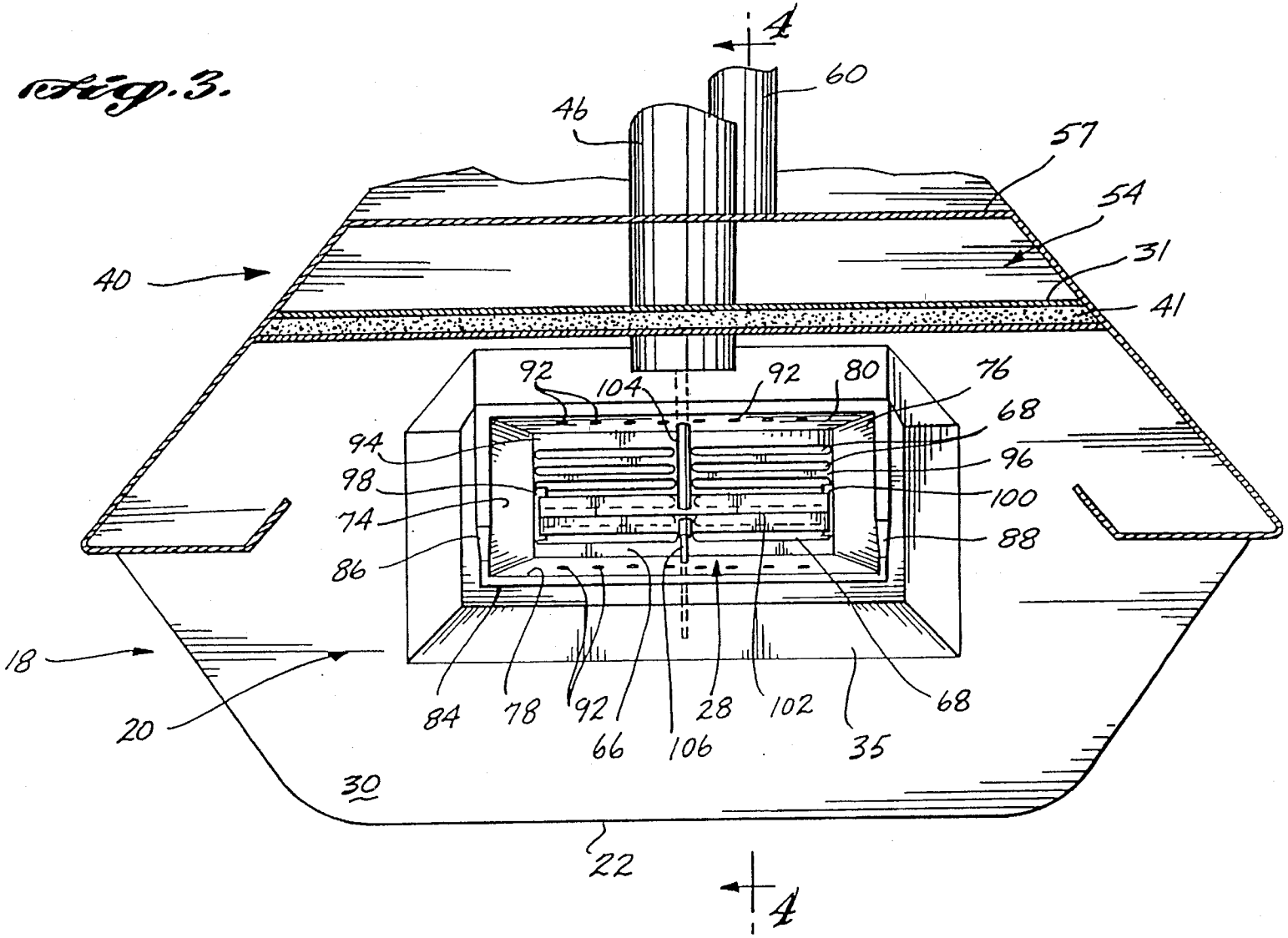
FIG. 3 is a top view of the grate assembly of FIG. 1.
Figure 4:
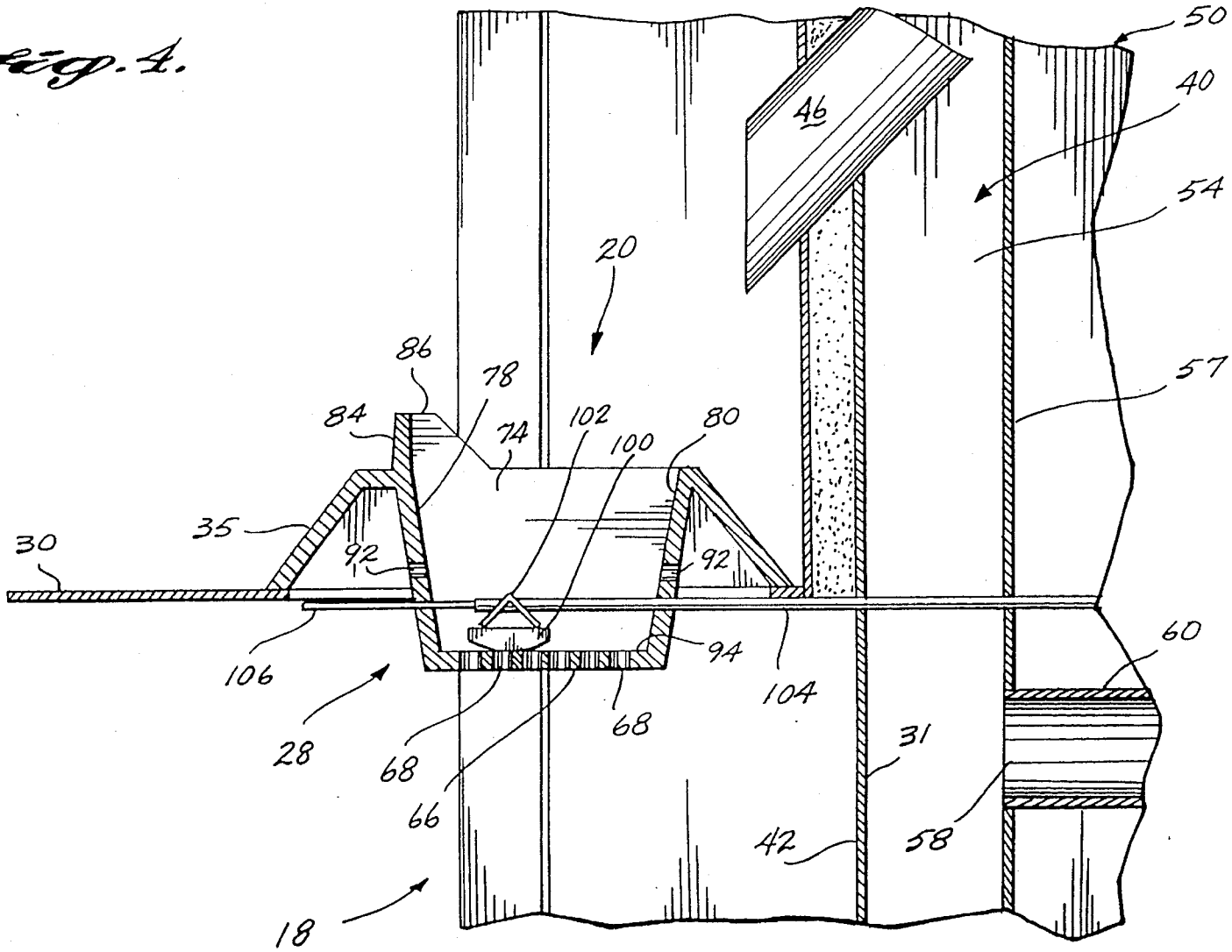
FIG. 4 is an elevation view of a cross section of the grate assembly of FIGS. 2 and 3 taken along line 4—4 in FIG. 3.

Referring to FIGS. 2, 3 and 4 which illustrate in more detail grate assembly 28 formed in accordance with the present invention, grate assembly 28 includes planar plate 66 which acts as a passive grate. Planar plate 66 is a flat, rectangular member made from conventional materials such as steel or iron. In the illustrated embodiment, a plurality of elongate slots 68 extend through planar plate 66. The length of slots 68 is substantially parallel to the length of planar plate 66. In the illustrated embodiment, slots 68 comprise a left and right set of slots. Although two sets of slots are preferred, other arrangements such as a single slot, more sets of slots or even a single set of slots are within the scope of the present invention. The set of slots 68 on the left-hand side of planar plate 66 extend from the left end 94 of planar plate 66 to about the center of planar plate 66. The set of slots 68 on the right-hand side of planar plate 66 extend from about the center to the right end 96 of planar plate 66. In this manner, slots 68 substantially abut the left end of planar plate 66 and the right end of planar plate 66. The width of slots 68 is less than the smallest diameter of the biomass pellets to be burned in stove 10. This prevents the pellets from falling through slots 68 into ash pan 24 before they are combusted. In the illustrated embodiment, elongate slots 68 have a width of about 0.15 to 0.25 inches. Slots of these dimensions are compatible with pellets having a diameter of about ¼ of an inch. Applicants have found that slots having a width falling within the ranges recited above provide the desired combination of support for the pelletized fuel and surface area through which combustion air may pass into the fire at a velocity that is insufficient to cause substantial dispersion of the ash. Furthermore, slots of this size provide a sufficiently sized gap through which ash may readily fall through the planar plate. As a guideline, the preferred number of slots 68 and their size should provide an open area through planar plate 66 of approximately 50–70 percent of the overall surface area of planar plate 66 without slots 68. Depending on the ash content of the fuel, use of planar plate as a passive grate will be sufficient to prevent undesirable accumulation of ash. Where the ash content is higher and the passive grate is unable to prevent undesirable accumulation of ash, the passive grate can be combined with a moveable arm as described below.

Grate assembly 28 further includes left wall 74 and right wall 76. Left and right walls 74 and 76 extend upward and slightly outward from left end 94 and right end 96 of planar plate 66. Extending upward and slightly outward from the front edge and rear edge of planar plate 66 are front wall 78 and rear wall 80. The rear ends of left wall 74 and right wall 76 are connected by rear wall 80. In a similar fashion, the front ends of left wall 74 and right wall 76 are connected by front wall 78. In this manner, the combination of the four walls serves to define a pot or cavity into which pelletized fuel is deposited and contained for combustion.

Planar plate 66 and walls 74, 76, 78, and 80 are suspended through the opening in platform 30. In the illustrated embodiment, suspension of planar plate 66 is accomplished by providing bulkhead 35 on top of platform 30 to which walls 74, 76, 78, and 80 are attached. Bulkhead 35 has a footprint that rests on platform 30 around the opening therethrough. Bulkhead 35 includes a left, right, front and rear wall that extend up from the footprint and have their upper edges connected to the top of left wall 74, right wall 76, front wall 78, and rear wall 80, respectively. The height of bulkhead 35 is less than the distance between planar plate 66 and the top of left wall 74, right wall 76, front wall 78 and rear wall 80. Accordingly, planar plate 66 is suspended below platform 30, with left wall 74, right wall 76, front wall 78 and rear wall 80 spaced apart from the edges of the opening in platform 30. As described below in more detail, the opening allows secondary combustion air to pass into the fire through front wall 78 and rear wall 80 above planar plate 66.

Front wall 78 above the surface where it is connected to bulkhead 35 includes a vertical extension 84 for deflecting errant fuel pellets from fuel feed conduit 46 onto planar plate 66. The forward-most ends of left wall 74 and right wall 76 above the surface where they are connected to bulkhead 35 also include vertical extensions 86 and 88 for deflecting errant pellets onto planar plate 66.

Front wall 78 and rear wall 80 include a plurality of secondary air holes 92. Air holes 92 are located above platform 30 about half-way up front wall 78 and rear wall 80. Air holes 92 provide a passage for air to enter the fire above planar plate 66.

Grate assembly 28 further includes an elongate blade 102 that extends transversely between walls 74 and 76 in a direction parallel to elongate slots 68. Elongate blade 102, although shown as having a cross section in the shape of a triangle, may also have a cross section in the shape of a circle or square. Elongate blade 102 is elevated above planar plate 66 by left skid 98 and right skid 100 that are attached to the underside of the ends of elongate blade 102. While skids 98 and 100 are described as being attached to the ends of elongate blade 102, they can be located at other positions along the length of elongate blade 102. Skids 98 and 100 rest on the upper surface of planar plate 66 and elevate elongate blade 102 above planar plate 66, a distance sufficient to prevent crushing of the pellets that are positioned under elongate blade 102. Skids 98 and 100 are about as wide as the underside of elongate blade 102. The forward and rearward ends of skids 98 and 100 are rounded which allows the skids to ride smoothly over elongate slots 68.

The center of elongate blade 102 is attached to movable arm 104 that is coupled to auger motor 62 by a mechanism, such as a spring and cable actuator arm. Activation of the spring and cable actuator arm by auger motor 62 causes movable arm 104 to move in a direction substantially transverse to the length of elongate slots 68. Movable arm 104 is a tubular member that passes over stationary rod 106 in a telescoping arrangement. Stationary rod 106 extends across the opening in platform 30 and through front wall 78 with its forward-most end affixed to the underside of platform 30. Stationary rod 106 extends rearward far enough so that reciprocation of movable arm 104 does not result in movable arm 104 coming off stationary rod 106. Movable arm 104 is coupled to auger motor 62; accordingly, it passes rearward through rear wall 80, fire wall 34 and wall 57 of chamber 54 into the rear section 50 of stove body 16. Movement of elongate blade 102 serves to direct accumulated ash into slots 68 where it fails into ash pan 24. Movement of elongate blade 102 also serves to break up clinkers into smaller pieces which can also fall through slots 68 into ash pan 24.

In operation, fuel pellets are introduced onto planar plate 66 from fuel feed conduit 46. The angle of fuel feed conduit 46 is such that the pellets will fall directly into the box provided above and around planar plate 66. For those errant pellets whose momentum tends to carry them outside of the box, vertical extensions 84, 86, and 88 serve to deflect the pellets onto planar plate 66. Combustion air is provided to the fire through slots 68 and secondary air holes 92. As combustion of the fuel progresses and ash is produced, it begins to fall through slots 68. If necessary, movable ann 104 can be provided and reciprocated causing elongate blade 102 to direct additional ash through slots 68 into ash pan 24. In addition, elongate blade 102 breaks up any clinkers that may have formed and pushes them into slots 68. Since movable arm 104 is coupled to auger motor 62, its movement can be synchronized with the introduction of additional fuel onto planar plate 66. In this manner, the energy of the falling fuel and the movement of elongate blade 102 can be combined to direct the ash into the slots as well as break up clinkers that may be forming.

Figure 5:
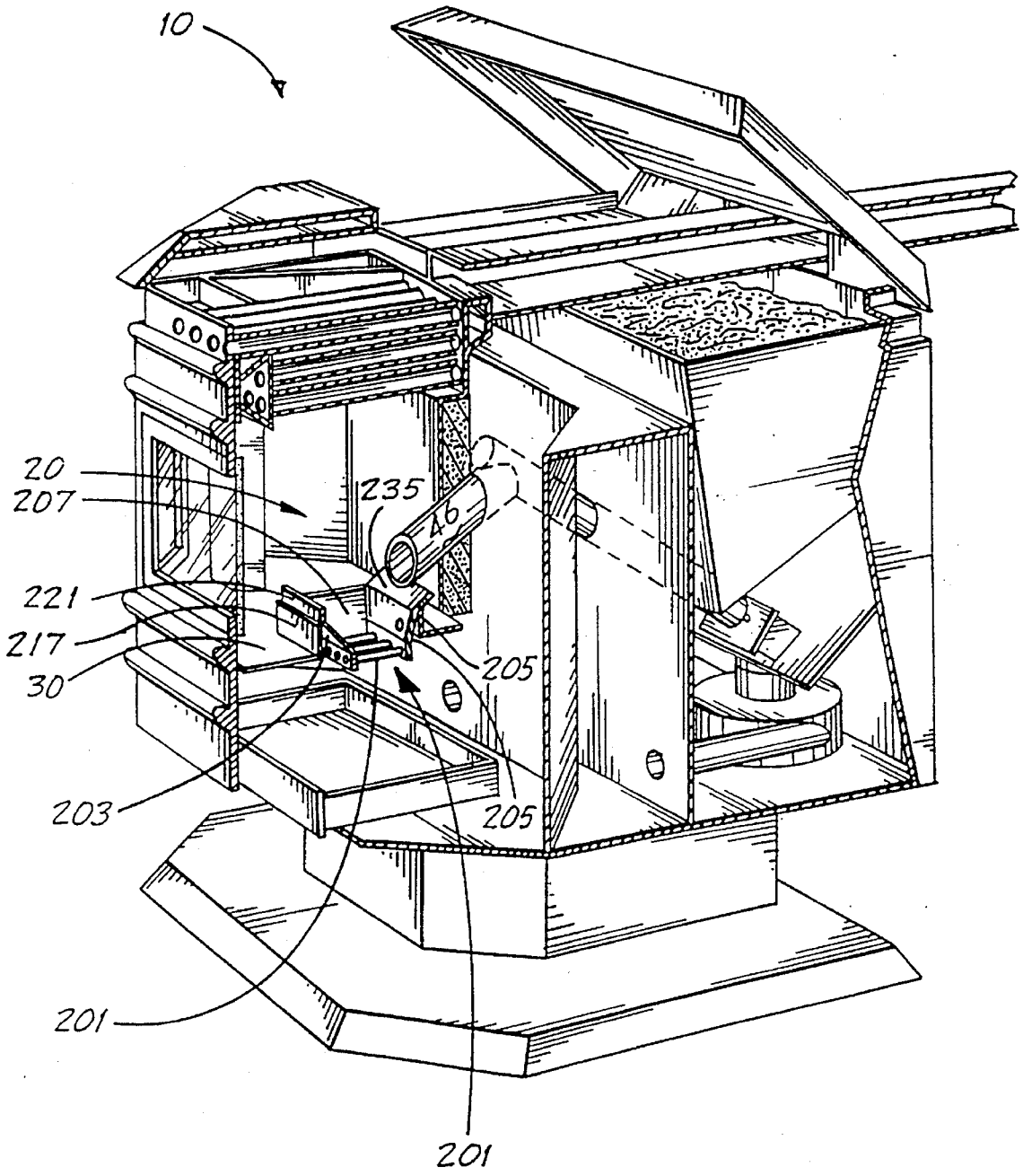
FIG. 5 is a perspective view of a stove fueled by biomass pellets with a portion cut away including a second embodiment of a grate assembly, including a passive grate formed in accordance with the present invention.

In an alternative embodiment, a passive grate formed in accordance with the present invention includes a plurality of rods that in combination serve as a platform for the fuel pellets. The spacing between adjacent rods is greater near the center of the plurality of rods compared to the spacing between the rods near the edges of the grate. The larger spacing near the center allows more combustion air to enter into the pile of burning pellets, where they are most highly concentrated. Near the edges of the grate, partially burned pellets tend to collect, and accordingly, the more narrow spacing between the rods keeps the partially burned pellets on the grate and continues to allow sufficient air to pass through the grate to complete the combustion. Referring to FIG. 5, this alternative embodiment of a passive grate is illustrated in a stove fueled by biomass pellets substantially identical to that described above with reference to FIG. 1. The grate of this embodiment generally indicated by reference 201 is located within firebox 20. Grate assembly 201, like grate assembly 28, is suspended within an opening in platform 30. Grate assembly 201 receives pellets from fuel feed conduit 46 as described above. The balance of the features of stove 10 are substantially identical to those described above and reference is made herein to the prior discussion.

Figure 6:
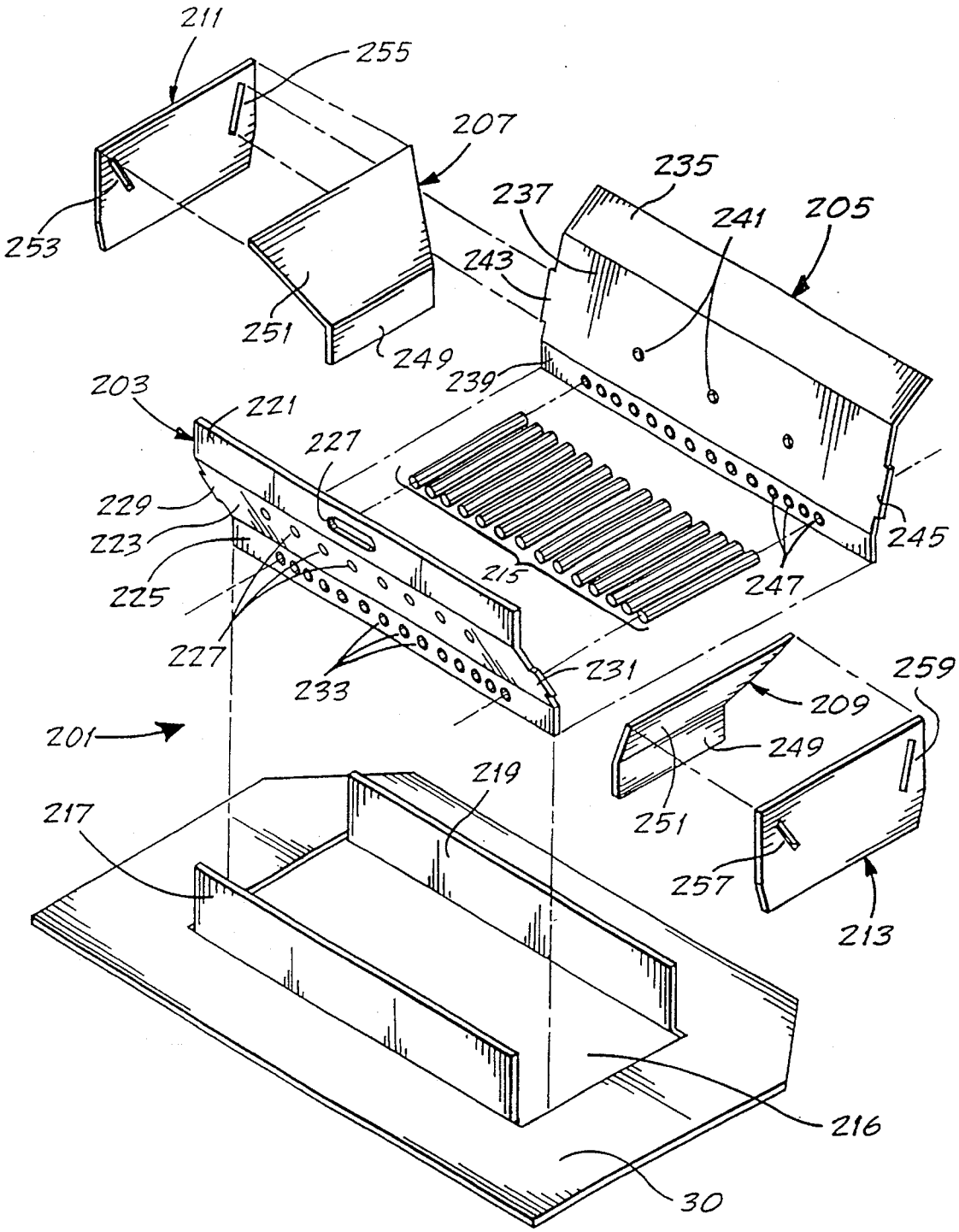
FIG. 6 is a perspective view of an assembly of the grate assembly of FIG. 5.
Figure 7:
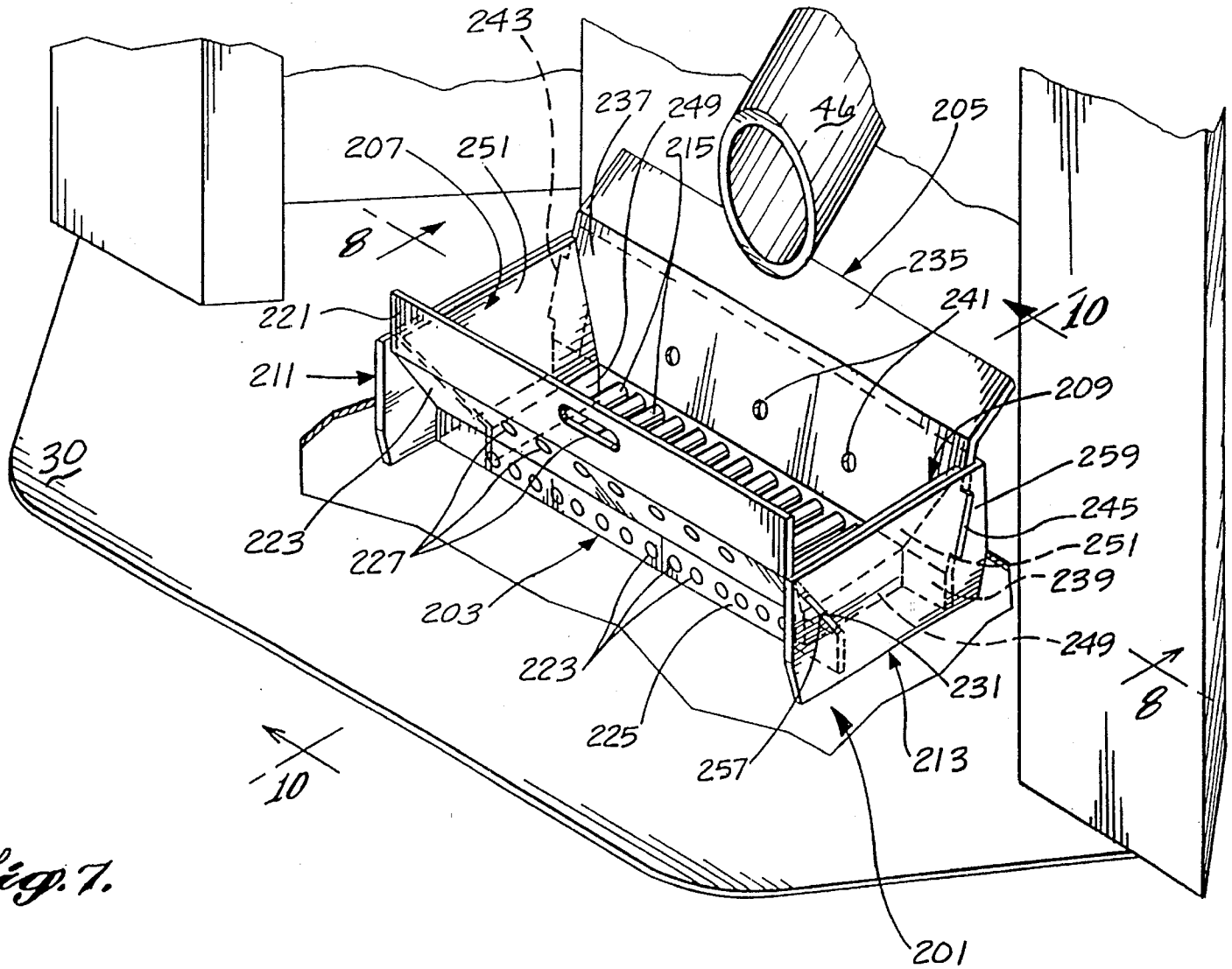
FIG. 7 is an enlarged perspective view of the grate assembly of FIG. 5.

Referring to FIGS. 6 and 7, more detailed drawings of grate assembly 201 are provided. Grate assembly 201 includes front wall 203, back wall 205, left side wall 207, right side wall 209, left bulkhead 211, right bulkhead 213 and a plurality of rods 215.

As described above, grate assembly 201, when assembled, is suspended within opening 216 in platform 30. Opening 216 in platform 30 is generally rectangular in shape with its front and rear edges being longer than its left and right edges. Extending upward from the front edge of opening 216 and perpendicular to platform 30 is from bulkhead 217. Front bulkhead 217 is a generally rectangular plate having a width substantially equal to the width of opening 216. The height of front bulkhead 217 is about one-sixth its width. Bulkhead 217 is high enough that it supports grate 201 within opening 216 such that rods 215 are below platform 30. Extending upward from the rearward edge of opening 216 and perpendicular to platform 30 is rear bulkhead 219. Rear bulkhead 219 has the same dimensions as from bulkhead 217. As described below in more detail, bulkheads 217 and 219 serve to support and suspend grate assembly 201 within opening 216.

Turning to the specific elements of grate assembly 201, front wall 203 is a generally rectangular shaped plate that includes an upper section 221, a middle section 223 and a lower section 225. Upper section 221 is a substantially vertical, rectangular plate having a width slightly less than the width of opening 216. The height of upper section 221 is approximately one-quarter of the overall height of front wall 203. Located at the center of upper section 221 is an opening 227 that passes through upper section 221. The opening 227 provides access to the grate to facilitate its cleaning. Upper section 221 serves as a deflection plate for errant pellets from fuel conduit 46.

Extending down from the lower edge of upper section 221 is middle section 223 that is also in the shape of a rectangle having a width equal to the width of front wall 203. Middle section 223 is inclined down towards the rear of grate assembly 201. In the illustrated embodiment, the slope of middle section 223 is approximately 30° from vertical. Centered along middle section 223 and arranged in a horizontal row are a plurality of openings 227. Openings 227 pass through middle section 223, and as described below allow secondary combustion air to flow through middle section 223. The left edge and the right edge of middle section 223 include outward extending rectangular tabs 229 and 231. Rectangular tabs 229 and 231 extend outward a distance approximately equal to the thickness of the plate making up middle section 223. The tabs 229 and 231 are offset towards the lower edge of middle section 223.

Extending downward from the lowermost edge of middle section 223 in a vertical plane is lower section 225. Lower section 225 is a substantially rectangular plate having a width equal to the width of front wall 203. The height of lower section 225 is approximately one-half the height of upper section 221. Lower section 225 includes a row of openings 233 passing therethrough. Openings 233 are arranged in a horizontal row substantially centered along lower section 225. Openings 233 are dimensioned to receive the ends of rods 215 as described in more detail below.

Back wall 205 is a substantially rectangular plate that includes an upper section 235, a middle section 237 and a lower section 239. Middle section 237 of back wall 205 is substantially a mirror image of middle section 223 of front wall 203. Middle section 237 contains fewer openings 241 compared to the number of openings 227 in middle section 223. Middle section 237, like middle section 223, slants down in an inward direction towards the center of grate assembly 201. The slope of middle section 237 is approximately 15° from vertical. Extending outward from the left edge and right edge of middle section 237 are rectangular tabs 243 and 245. Rectangular tabs 243 and 245 are substantially identical to tabs 229 and 231 in size and placement.

Extending upward from the upper edge of middle section 237 is upper section 235. Upper section 235 is a generally rectangular plate having a width equal to the width of back wall 205 and a height that is approximately one-quarter of the overall height of back wall 205. In the illustrated embodiment, upper section 235 slants less steeply towards the center of grate assembly 201 than middle section 237. The angle that upper section 235 forms with vertical is approximately 55° in the illustrated embodiment. Upper section 235 serves to deflect errant pellets from fuel conduit 46 onto rods 215.

Extending vertically downward from the lowermost edge of middle section 237 is lower section 239. Lower section 239 is a substantially mirror image of lower section 225. Lower section 239 includes a plurality of openings 247 identical to openings 233 in lower section 225. Openings 247 are aligned in a horizontal row that is centered approximately along the middle of lower section 239.

Front wall 203 and rear wall 205 are connected at their edges by end walls 207 and 209 to form a "bum pot" above rods 215. End walls 207 and 209 are substantially mirror images of each other. End walls 207 and 209 include a lower rectangular portion 249 and an upper trapezoidal portion 251. Lower rectangular portion 249 is a generally vertical plate that has a width that is substantially equal to the distance between lower sections 225 and 239 when grate assembly 201 is assembled. The height of rectangular section 249 is substantially equal to the height of lower sections 225 and 239. The upper trapezoidal section of side walls 207 and 209 has a lower edge having a width substantially equal to the width of rectangular section 249 and an upper edge having a width substantially equal to the distance between the lowermost edges of upper sections 221 and 235 when grate assembly 201 is assembled. Trapezoidal section 251 slants upward and outward from the upper edge of rectangular portion 249. The trapezoidal shape of section 251 allows it to fit snugly between front wall 203 and back wall 205 when grate assembly 201 is assembled. In this matter, side walls 207 and 209 extend between and serve to close off the ends of front wall 203 and back wall 205. When assembled, rectangular section 249 is positioned inside the leftmost and rightmost edges of front wall 203 and back wall 205. In contrast, the uppermost edge of trapezoidal section 251 coincides with the uppermost and outermost edges of middle sections 223 and 237.

Grate assembly 201 also includes a plurality of rods 215. In the illustrated embodiment, rods 215 are circular in cross section. Rods 215 can be machined from stainless steel, preferably a stainless steel with low carbon content. Rods 215 have an outer diameter that allows them to slide into openings 233 and 247. Rods 215 should be long enough so that when grate assembly 201 is assembled the rods are able to extend between openings 233 and 247. The spacing between adjacent rods is established by the spacing between the openings 233 and 247. In the illustrated embodiment, the spacing between adjacent rods 215 is greatest at the center of grate assembly 201 and decreases as one moves towards the left and right edges of grate assembly 201. Generally, the spacing near the center should be such that fresh unburned pellets will not fall through rods 215 and into the ash pan. Near the edges of grate assembly 201, the spacing between rods 215 can be narrower to keep partially burned pellets on grate 201 for complete combustion. Another concern, as discussed above, is that the spacing between adjacent rods 215 should not be so narrow that the rate of flow of air through the openings is so great that ash is blown about. As an example of suitable spacing of rods 215 for the combustion of ¼ inch diameter pellets on a grate having 14 rods, the following dimensions are provided, as measured from the centerline of the grate to the center of openings 223 or 247. The rods are identified based on their proximity to the centerline and whether they are to the left (L) or right (R) of the centerline.

| Rod | Distance (inches) |
|---|---|
| 1L, 1R | 0.207 |
| 2L, 2R | 0.605 |
| 3L, 3R | 0.997 |
| 4L, 4R | 1.367 |
| 5L, 5R | 1.707 |
| 6L, 6R | 2.029 |
| 7L, 7R | 2.341 |

The illustrated embodiment shows rods having a diameter of about 0.20 inches and a circular cross section. Other shapes of rods that are non-circular can be used. Circular rods are preferred because they do not provide any flat surfaces upon which ash and clinkers can accumulate. This causes the grate to be substantially selfcleaning as long as the openings between the rods do not become clogged with clinkers. Other shapes of rods that would be suitable include triangular and oval rods.

In order to secure rods 215, one end of rods 215 is affixed within openings 233 or 247. Exemplary types of attachment include welding and the like. The end of rods 215 that are not attached within the openings are carried within the opposing openings but are not attached thereto. This allows rods 215 to expand in length without inducing stresses that could cause buckling of the affixed elements.

Grate assembly 201 also includes left bulkhead 211 and right bulkhead 213. Left bulkhead 211 and right bulkhead 213 are mirror images of each other. Accordingly, a description of one is equally applicable to the other. Left bulkhead 211 is a generally rectangular plate having a width greater than the distance between tabs 229 and 243 when grate assembly 201 is assembled. Bulkhead 211 has a height that is approximately equal to the combined height of lower section 225 and middle section 223 of from wall 203. Left bulkhead 211 includes a slot 253 for receiving tab 229 and slot 255 for receiving tab 243 when grate assembly 201 is assembled. In a similar fashion, right bulkhead 213 includes slot 257 for receiving notch 231 and slot 259 for receiving notch 245. When assembled, left bulkhead 211 extends between the left end of front wall 203 and back wall 205. In a similar fashion, right bulkhead 213 extends between the right end of front wall 203 and back wall 205.

Figure 8:
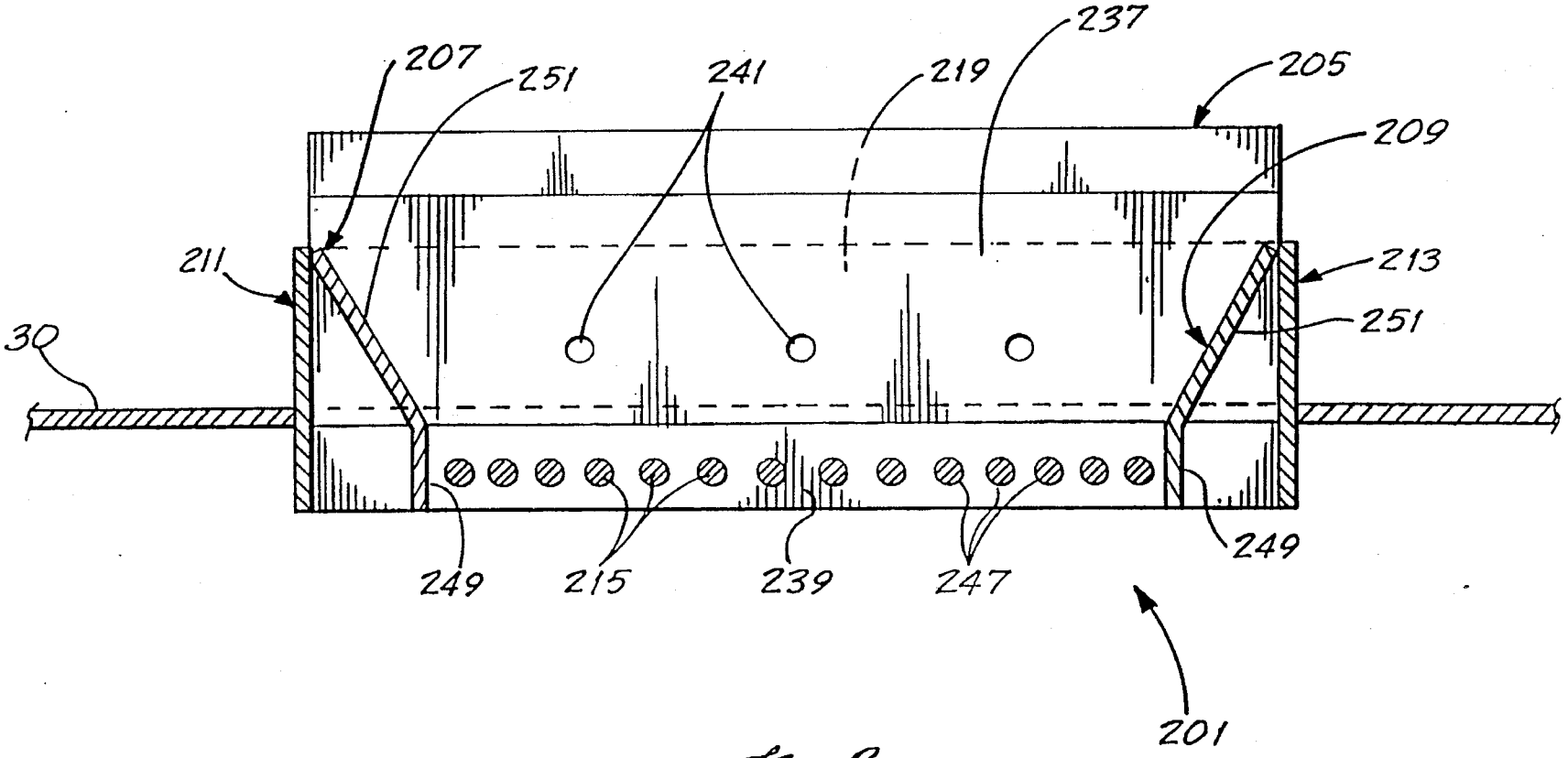
FIG. 8 is an elevation view of a cross section of the grate assembly of FIG. 7 taken along line 8—8 in FIG. 7.
Figure 9:
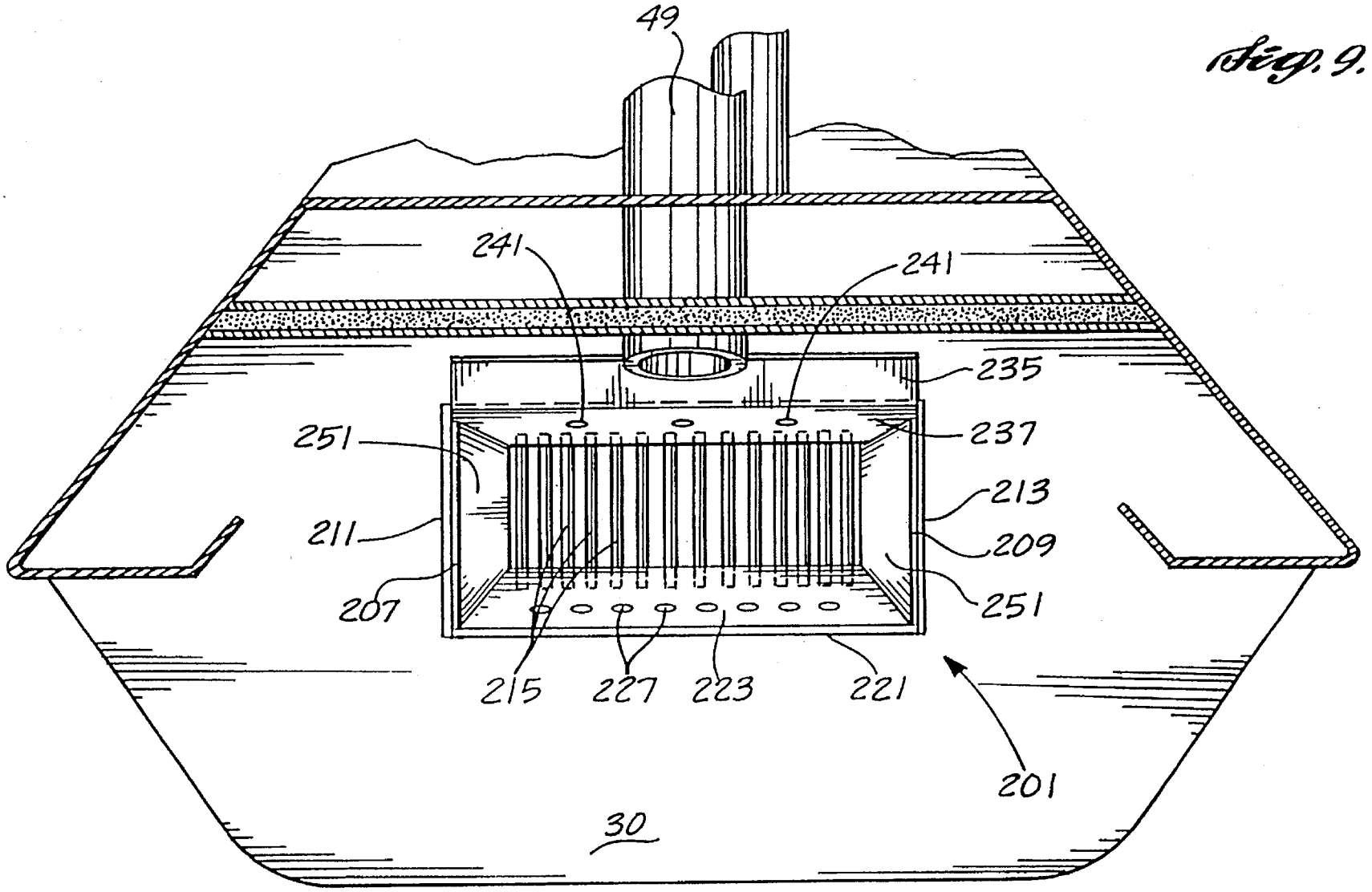
FIG. 9 is a top view of the grate assembly of FIG. 5.
Figure 10:
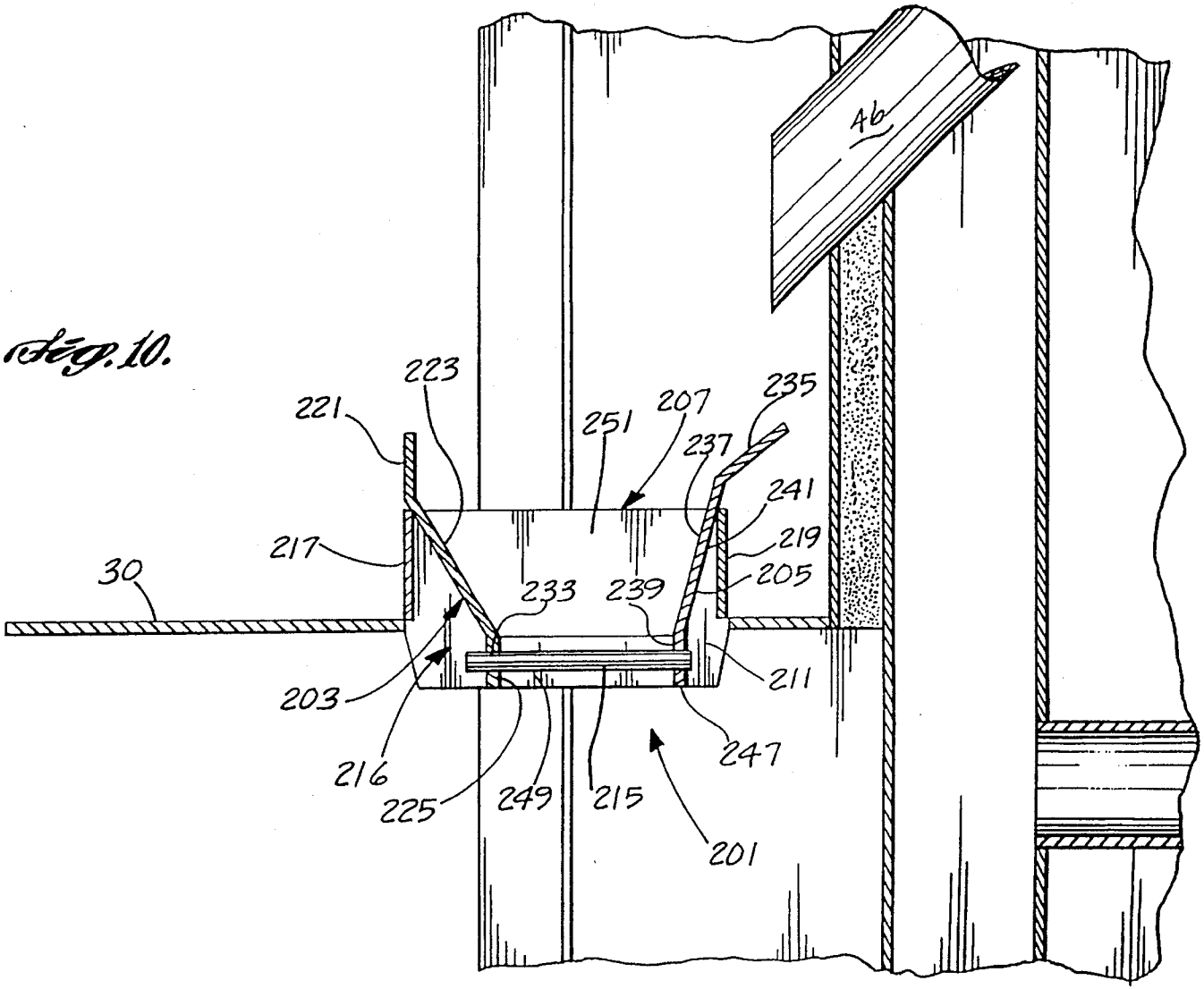
FIG. 10 is an elevation view of a cross section of the grate assembly of FIG. 7 taken along line 10—10 in FIG. 7.

Referring additionally to FIGS. 8, 9 and 10, grate 201 when assembled is suspended within opening 216 in platform 30. Front bulkhead 217 and rear bulkhead 219 serve to support front wall 203 and back wall 205 respectively. Left bulkhead 211 and right bulkhead 213 rest upon the upper surface of platform 30 and help to support the grate assembly 201 within opening 216.

In operation, combustion air is introduced into the "burn pot" from beneath rods 215 as well as through the openings 227 and 241. As the pellets burn and ash forms, in the illustrated embodiment the rounded surfaces provided by the rods plus the added activation caused by pellets dropping into the grate from above and the flow of combustion air upwards through the grate rods cause the ash to fall between rods 215 and into the ash pan.

The passive grate and grate assembly of the present invention prevents the slots from becoming clogged, which can reduce the amount of air that is provided to the fire. By minimizing clogging of the slots, the efficiency of the combustion and heat output and the ability to burn over long periods of time is not compromised.

Figure 11:
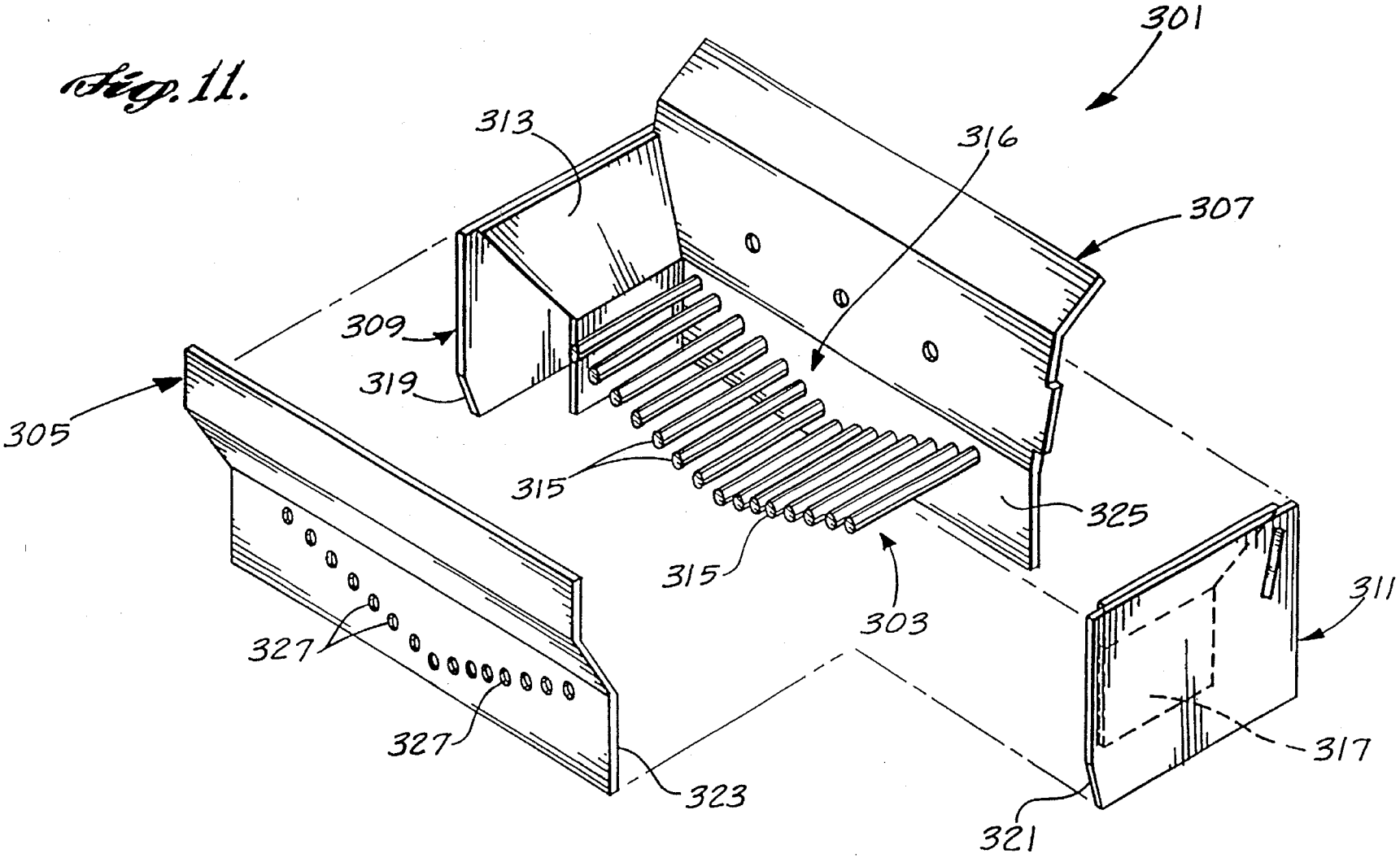
FIG. 11 is a perspective view of a grate assembly including the selfconcentrating feature of the present invention.
Figure 12:
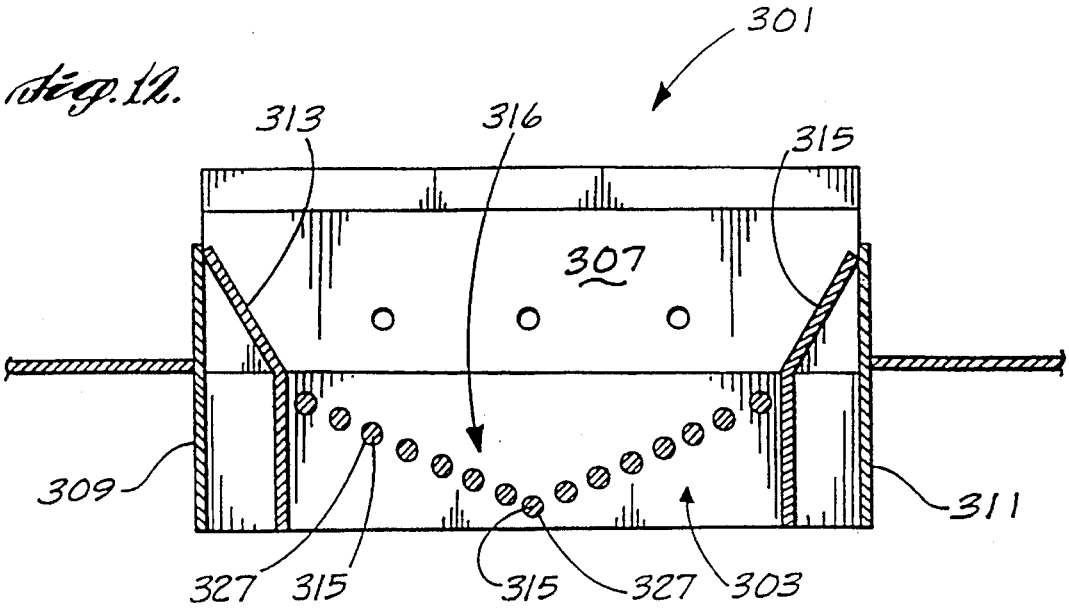
FIG. 12 is an elevation view of a cross section of the grate assembly of FIG. 11, taken along line 12—12 in FIG. 11.

Under certain conditions, it is preferred that the feed rate of pellets to the combustion chamber be low. At low feed rates, it is imperative that the fuel pellets be maintained in a compact volume for efficient combustion. Having individual pellets strewn across the grate is undesirable because they will not combust fully or efficiently and an excessive amount of combustion air is required. Referring to FIG. 11, in another aspect of the present invention, a passive grate is provided similar to the passive grate described above with the added feature that the plurality of rods defines a trough within the grate assembly so that fuel pellets fed into the combustion chamber are concentrated within a compact volume for efficient combustion. As described above, grate assembly 301 is provided within the combustion chamber directly below the fuel feed conduit 46 (in FIG. 7) so that fuel pellets exiting the fuel feed conduit are received onto grate 303. Referring to FIGS. 11 and 12, a detailed drawing of grate assembly 301 formed in accordance with this aspect of the present invention is provided. Grate assembly 301 includes front wall 305, back wall 307, left side wall 309, right side wall 311, left bulkhead 313, right bulkhead 317, and plurality of rods 315 that are similar to those same elements as described above with respect to FIGS. 6 and 7. Accordingly, the reader is directed to the previous description for the basic understanding of these elements. The differences between the foregoing elements of the grate assembly illustrated in FIGS. 6 and 7 and grate assembly 301 illustrated in FIGS. 11 and 12 are described below.

Because grate 303 includes trough 316 that causes grate 303 to have a depth greater than the grate of FIGS. 6 and 7, lower sections 319, 321, 323 and 325 of respective left side wall 309, right side wall 311, front wall 305, and back wall 307 extend downward farther than lower sections 249 of left side wall 207 and right side wall 209, and lower sections 239 and 225 of back wall 205 and from wall 203 in FIG. 6. The added length of the respective lower sections is required to provide a framework for supporting plurality of rods 315 in a trough arrangement in accordance with this aspect of the present invention.

Figure 13:
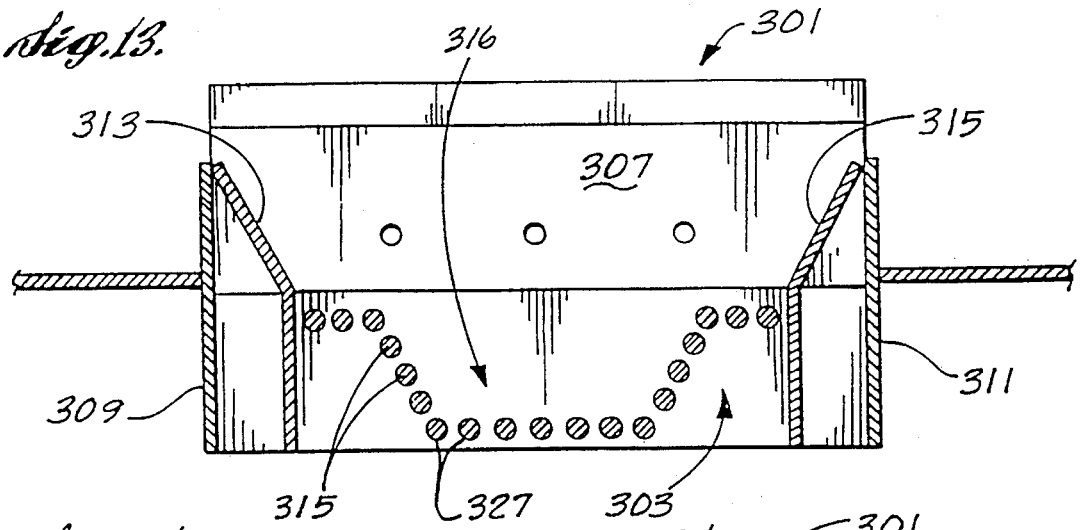
FIG. 13 is an elevation view of a cross section of an alternative embodiment of the grate assembly of FIG. 12.
Figure 14:
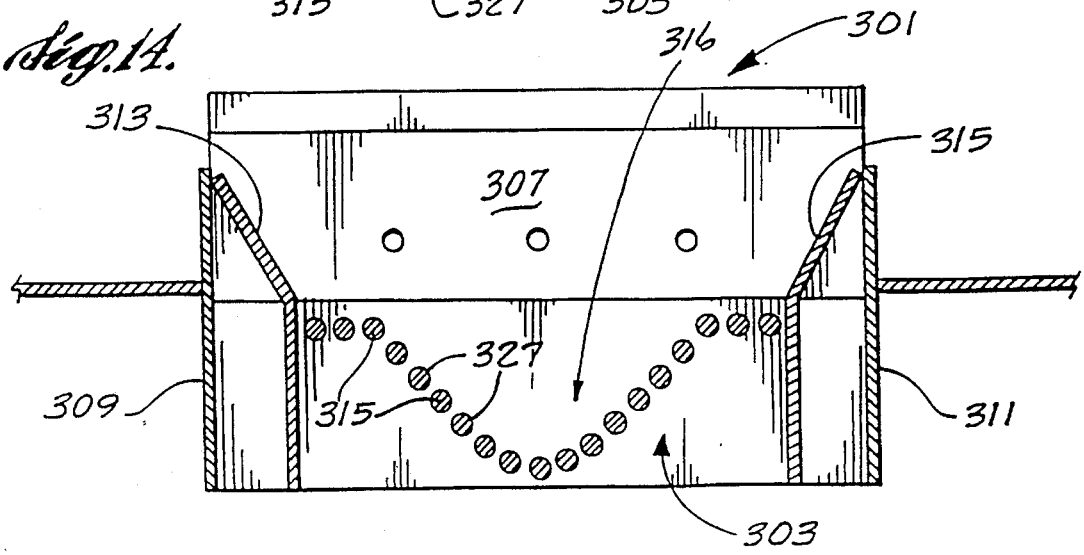
FIG. 14 is an elevation view of a cross section of an alternative embodiment of the grate assembly of FIG. 12.

Lower sections 323 and 325 of respective front wall 305 and back wall 307 include a plurality of openings 327 sized to receive opposing ends of rods 315. Openings 327 are positioned in lower sections in a pattern that provides trough 316 centered within grate 303. In the illustrated embodiment, the center of openings 327 are equal distance from each other. In an alternative embodiment not illustrated, the spacing between the centers of adjacent openings can be unequal, for example with the spacing set forth on the table above. When the opposing ends of rods 315 are inserted into openings 327, as described above, a trough is formed in the center of passive grate 303. Trough 316 formed by rods 315 of grate 303 can be of different shapes. In the embodiment illustrated in FIGS. 11 and 12, the trough is V-shaped. In the embodiment illustrated in FIG. 13, the trough is U-shaped. In the embodiment illustrated in FIG. 14, the trough is trapezoidal in shape. The particular shape of the trough can be determined by the pattern in which openings 327 are provided in lower sections 323 and 325 of front wall 305 and back wall 307. In the illustrated embodiments, the trough has a depth equal to several times the diameter of the rods. Preferably, the trough has a depth greater than or equal to the diameter of the rods.

When fuel pellets are fed onto passive grate 301, gravity directs the pellets to the bottom of trough 316. In this manner, unburned pellets fed to passive grate 303 are concentrated and maintained in a compact volume within trough 316. This concentration of fuel pellets allows for efficient combustion thereof.

At high feed rates, the concentration of the fuel pellets into a compact volume has the undesirable effect of reducing the ability of fresh fuel pellets to break up clinkers that accumulate near the bottom of the fuel pile. If the pile of fuel becomes excessive, the force of the impact by the fresh fuel onto the fuel pile is not transferred to the bottom of the pile where the clinkers are prevalent. Referring to FIG. 15, in another embodiment of the present invention a self-distributing grate assembly is provided that reduces the build up of the fuel while still permitting efficient combustion.

Although the passive grate and grate assembly described above with respect to FIGS. 11–14 have utility in many applications, the range of fuel feed rates over which efficient combustion is achieved may not be as broadly desired. For example, at high feed rates, there is a tendency for the fuel pellets to build up to a depth such that the impact of fresh pellets deposited on the pile is not distributed to the bottom of the pile where the clinkers are most prevalent. Accordingly, the impact of the fresh pellets is unable to provide the force necessary to break up the clinkers allowing them to fall between adjacent rods. Also, when the fuel pellets are concentrated in a compact volume the efficiency of combustion is less than optimal because portions of the grate that are not covered by fuel allow combustion air to pass through unutilized. At low feed rates, the buildup of fuel pellets to an excessive depth is of less concern; however, the concern for efficient utilization of combustion air is still an issue for grates and grate assemblies that tend to concentrate the fuel pellets into a compact volume. To address these shortcomings, applicants have developed a self-distributing grate, which resembles the grate and grate assembly described above with respect to FIGS. 11, 12 and 14, with the exception that the pattern of the rods is inverted to produce a grate having a left edge and a right edge that are below an intermediate position of the grate where fuel pellets are deposited onto the grate.

Figure 16:
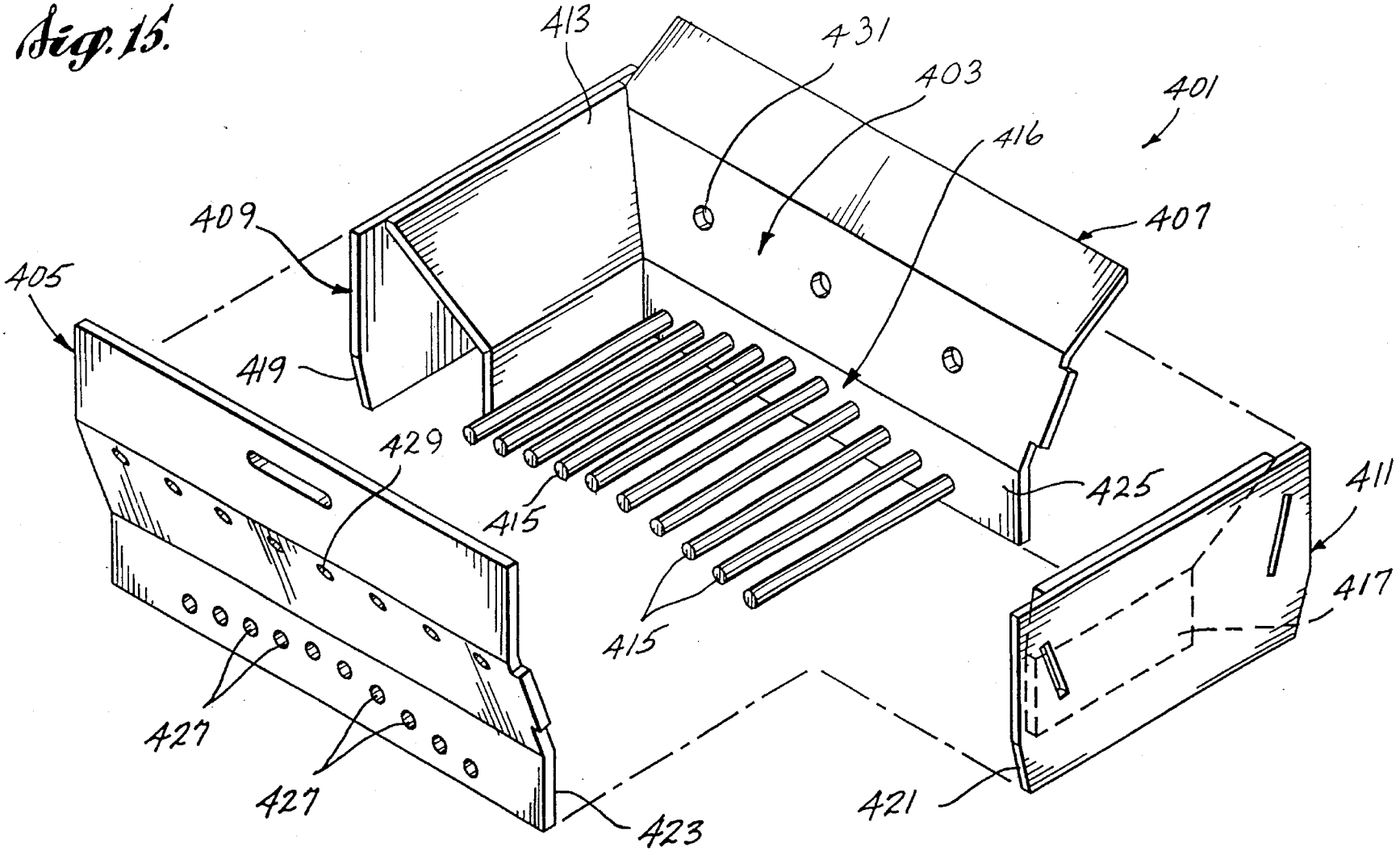
FIG. 16 is an elevation view of a cross section of the grate assembly of FIG. 15 taken along line 15—15 of FIG. 15.
Figure 16:
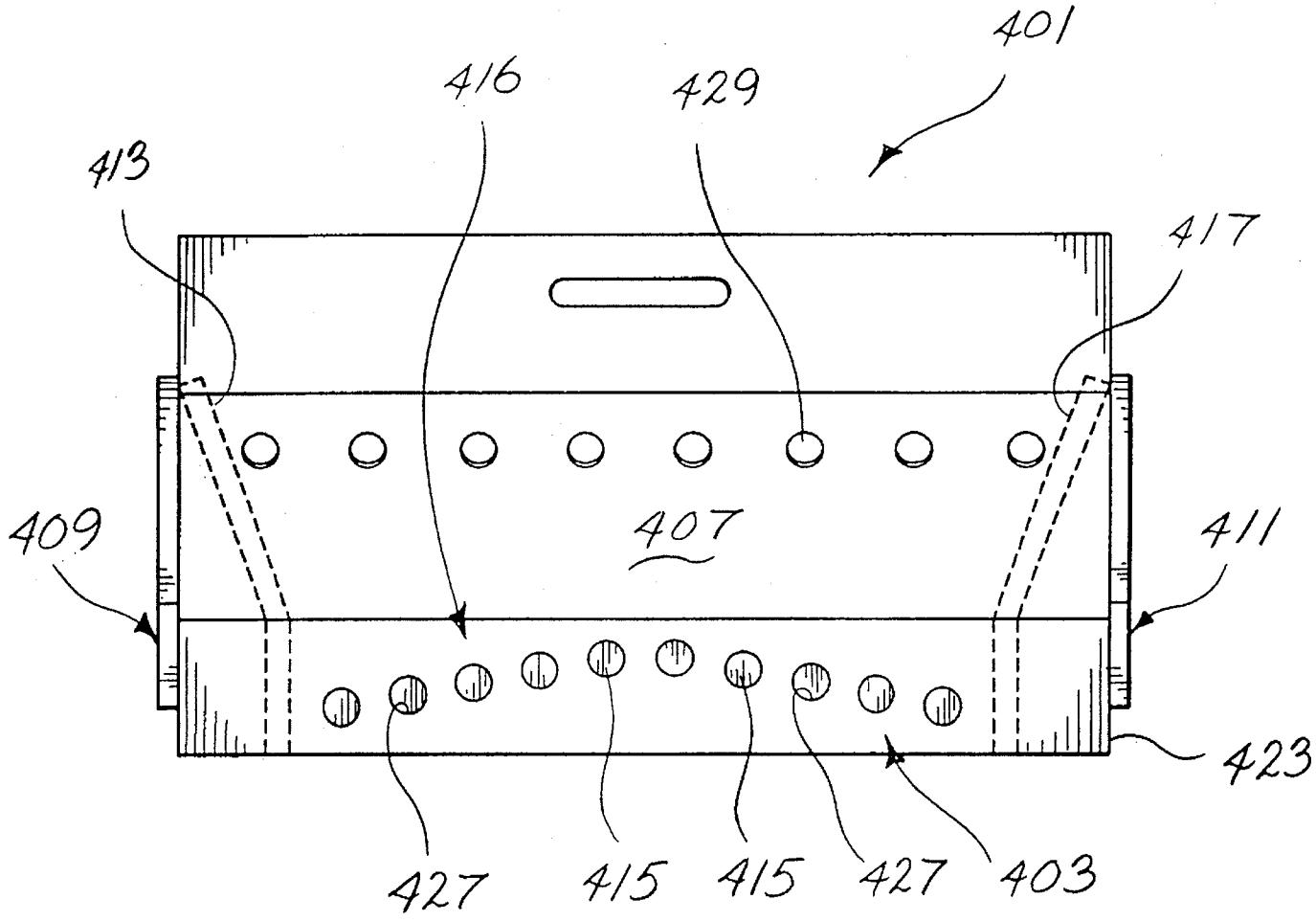

Referring to FIGS. 15 and 16, a passive grate 401 formed in accordance with this aspect of the present invention includes front wall 405, back wall 407, left side wall 409, right side wall 411, left bulkhead 4 13, and right bulkhead 417, that are substantially similar to those same elements as described above with respect to FIGS. 11–14 using the 300 series of reference numerals. Accordingly, the reader is directed to the previous description for a basic understanding of these elements. The differences between the foregoing elements and the grate assembly illustrated in FIGS. 11–14 and grate assembly 401 illustrated in FIGS. 15 and 16 are described below.

Overall, grate assembly 401 includes grate 403 that is generally squarer in overall shape than the grates described above with respect to previous embodiments. To accommodate the plurality of rods 415, grate 401 includes lower sections 419, 421, 423 and 425 of respective left sidewall 409, right sidewall 411, front wall 405, and back wall 407, that are similar to lower sections 319, 321, 323 and 325, described above with respect to FIGS. 11–14. The primary difference between these elements and those described above with respect to FIGS. 11–14 is in lower sections 423 and 425.

Lower sections 423 and 425 of respective front wall 405 and back wall 407 include ten openings 427 sized to receive opposing ends of rods 415. Openings 427 are positioned in lower section in a pattern that provides a grate 403 having an upper surface 416 that is substantially convex in shape and centered within grate 403. In the illustrated embodiment, the spacing between adjacent rods ranges from 0.36 to 0.38 inches, measured from the vertical centerlines of adjacent rods. The spacing between the horizontal centerlines of adjacent rods in the illustrated embodiment ranges from 0.06 to 0.07 inches. The spacing described above pertains to rods that are circular in cross section and have an outer diameter of about 3/16 of an inch. It should be understood that different numbers of and other shapes and sizes of rods are equally applicable, provided they provide the desired spacing between adjacent surfaces. Preferably, the space between adjacent rods ranges from about 60% to 100% of the diameter of the fuel pellets to be burned. In this manner, the grate is able to maintain the unburned fuel pellets above the grate, where they can be fully combusted, while allowing clinkers and ash to fall below the grate. In the illustrated embodiment, the spacing between the vertical centerlines of the left-most four rods is 0.36 inches. The spacing between the vertical centerlines of the fourth, fifth, sixth and seventh rods from the left-hand edge of the grate is about 0.38 inches. The spacing between the vertical centerlines of the seventh, eighth, ninth, and tenth rods from the left edge is about 0.36 inches. With respect to the spacing between the horizontal centerlines of the first and second rods from the left edge, such spacing is about 0.07 inches. The spacing between the horizontal centerlines of the second, third and fourth rods from the left edge is about 0.06 inches, and the spacing between the horizontal centerline of the fourth and fifth rods from the left edge is about 0.07 inches. The horizontal centerlines of the fifth and sixth rods are essentially coextensive in the illustrated embodiment. The rods making up the balance of the grate have a spacing between their horizontal centerlines that is a mirror image of those of the first through the fifth rods.

In the illustrated embodiment, frontwall 405 includes eight spaced openings 429 that allow secondary combustion air to feed the burning fuel. Additional openings or fewer openings can be used. In the illustrated embodiment, the openings are equally spaced; however, this is not a requirement for the present invention. Additional secondary combustion gas is also provided through openings 431 in backwall 407.

It should also be understood that the relative spacing between the rods may vary to provide desired results. For example, the spacing may be equal or may increase or decrease as the rods get closer to the center of the grate. In addition, different patterns of rods can be provided to provide a convex upper surface. For example, the pattern of rods can be an inverted "U" shape, an inverted "V" shape, arcuate, stepped, or semi-trapezoidal. Preferably, the apex of the convex surface is centered below the position where fuel pellets are introduced onto the grate and the left and right edges are below this apex.

In operation, at high feed rates the fuel pellets deposited onto the grate will tend to build up on the center of the grate.

As combustion progresses, clinkers and ash begin to form at the bottom of this pile. The impact of additional fuel pellets that are deposited on the pile help to force the ash and clinkers either through the open spaces in the grate or out from under the pile towards the left and right edges. This distribution of the fuel pile increases the surface area of available fuel. This increased surface area results in more efficient utilization of combustion air passing through the grate. At low feed rates, the slope of the grate's upper surface causes pellets to distribute themselves across the grate. Efficient combustion is obtained at low feed rates due to the large area occupied by burning pellets.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A grate assembly for use in a stove fueled by biomass pellets wherein the biomass pellets are introduced onto the grate assembly through a fuel feed conduit, the grate assembly comprising:

a frame; and a plurality of elongate rods supported by the frame in a parallel arrangement, the distance between adjacent rods being sufficient to prevent unburned biomass pellets from falling between adjacent rods, wherein the plurality of elongate rods define a grate having a left edge portion, a right edge portion, and a center portion that is positioned beneath the fuel feed conduit, the plurality of elongate rods forming the left edge portion and the plurality of rods forming the right edge portion being below the plurality of elongate rods forming the center portion.

2. The grate assembly of claim 1, wherein the grate has an upper surface that is substantially convex in shape.

3. The grate assembly of claim 2, wherein the upper surface is arcuate.

4. The grate assembly of claim 1, wherein the grate assembly distributes the pellets along the grate assembly from the location that the grate assembly receives the pellets from the fuel feed conduit.

5. The grate assembly of claim 1, wherein the plurality of rods comprises subsets of two rods, the distance between the rods of a first subset being substantially equal to the distance between rods of a second subset adjacent to the first subset.

6. The grate assembly of claim 5, wherein the distance between adjacent rods is about 60 percent to 100 percent of the diameter of the unburned biomass pellets.

7. The grate assembly of claim 1, wherein the plurality of rods comprises subsets of two rods, the distance between the rods of a first subset being unequal to the distance between rods of a second subset adjacent to the first subset.

8. The grate assembly of claim 7, wherein the spacing between subsets of rods increases as the subsets get closer to the center portion of the grate beneath the fuel feed conduit.

9. The grate assembly of claim 8, wherein the distance between adjacent rods is about 60 percent to 100 percent of the diameter of the unburned biomass pellets.

10. The grate assembly of claim 1, wherein the rods have a circular cross section.

11. The grate assembly of claim 1, wherein the rods have a non-circular cross section.

12. The grate assembly of claim 1, wherein the grate has an upper surface that is stepped.

* * * * *

UNITED STATES PATENT AND TRADEMARK OFFICE

CERTIFICATE OF CORRECTION

PATENT NO. : 5,488,943

DATED : February 6, 1996

INVENTOR(S) : O.J. Whitfield et al.

It is certified that error appears in the above-indentified patent and that said Letters Patent is hereby corrected as shown below:

ON THE TITLE PAGE:

| | | |
|---|---|---|
| [56] (Pg. 1, col. 1) | Refs. Cited (U.S. Pats., Item 9) | "12/1908 Rathbone" should read --10/1908 Rathbone-- |

| Column | Line | |
|---|---|---|
| 2 | 24 | "bum" should read --burn-- |
| 4 | 18 | "selfconcentrating" should read --self-concentrating-- |
| 4 | 27 | "selfdistributing" should read --self-distributing-- |
| 8 | 23 | "fails" should read --falls-- |
| 8 | 36 | "ann" should read --arm-- |
| 9 | 14 | "from" should read --front-- |
| 9 | 23 | "from" should read --front-- |

UNITED STATES PATENT AND TRADEMARK OFFICE

CERTIFICATE OF CORRECTION

PATENT NO. : 5,488,943

DATED : February 6, 1996

INVENTOR(S) : O.J. Whitfield et al.

It is certified that error appears in the above-indentified patent and that said Letters Patent is hereby corrected as shown below:

| COLUMN | LINE | |
|---|---|---|
| 10 | 31 | "bum pot" should read --burn pot--. |
| 11 | 32 | "selfcleaning" should read --self-cleaning-- |
| 11 | 51 | "from" should read --front-- |
| 12 | 49 | "from" should read --front-- |
| 13 | 55 | "bulkhead 4 13," should read --bulkhead 413,-- |

Signed and Sealed this

Ninth Day of July, 1996

*Attest:*

*Attesting Officer*

BRUCE LEHMAN

*Commissioner of Patents and Trademarks*